United States Patent [19]

Hufault et al.

[11] Patent Number: 5,042,742

[45] Date of Patent: Aug. 27, 1991

[54] MICROCONTROLLER FOR CONTROLLING AN AIRBORNE VEHICLE

[75] Inventors: John R. Hufault, Oro Valley; Martin Woznica, Tucson, both of Ariz.

[73] Assignee: Hughes Aircraft Company, Los Angeles, Calif.

[21] Appl. No.: 455,699

[22] Filed: Dec. 22, 1989

[51] Int. Cl.[5] ..... F42B 15/01; F41G 7/30

[52] U.S. Cl. ..... 244/3.11; 244/3.12; 244/3.14; 364/424.01; 235/400

[58] Field of Search ..... 244/3.11, 3.13, 3.14, 244/3.12; 364/423, 424.01; 235/400, 403

[56] References Cited

U.S. PATENT DOCUMENTS

| | | | |
|---|---|---|---|
| 3,008,668 | 11/1961 | Darlington | 244/3.11 |
| 3,974,984 | 8/1976 | Dobson et al. | 244/3.11 |
| 4,037,202 | 7/1977 | Terzian | 244/3.11 |
| 4,406,429 | 9/1983 | Allen | 244/3.11 |
| 4,611,771 | 9/1986 | Gibbons et al. | 244/3.11 |
| 4,705,237 | 11/1987 | Goldfeld et al. | 244/3.11 |

*Primary Examiner*—Michael J. Carone

*Attorney, Agent, or Firm*—C. D. Brown; R. M. Heald; W. K. Denson-Low

[57] ABSTRACT

An apparatus for controlling an airborne vehicle (18) includes a guidance unit (28), remotely located from the vehicle (18), for generating frequency modulated steering and control signals. A signal conditioning circuit (38) within the vehicle (18) conditions steering and control signals from the guidance unit (28). An attitude position sensing circuit (56) within the vehicle (18) senses and generates vehicle attitude position information. A programmable microcontroller (70) within the vehicle (18) receives the steering and control signals from the signal conditioning circuit (38) and vehicle attitude position information from the attitude position sensing circuit (56), and generates flight commands for controlling the flight of the vehicle (18).

16 Claims, 3 Drawing Sheets

MICROCONTROLLER FOR CONTROLLING AN AIRBORNE VEHICLE

This invention was made with Government support under Contract No. DAAH01-86-C-1131 awarded by the Department of the Army. The Government has certain rights in this invention.

BACKGROUND OF THE INVENTION

1. Technical Field

The present invention relates to missiles, and more specifically to programmable microcontrollers within missiles for controlling missile flight.

2. Discussion

The preferred embodiment of the present invention relates to the Tube-launched Optically tracked, Wire command link guided missile, more frequently referred to by the acronym TOW. The TOW missile is primarily an anti-tank weapon, having a maximum range of approximately 3,750 meters. This missile is capable of employment from a ground tripod, a military ground vehicle, or a military helicopter.

Operation of the TOW weapon system normally requires a two-man crew. After positioning the launcher, the operator looks through a combination day or night optical site to align the launcher with the path to the target. The operator then engages the firing mechanism.

During the flight phase, the missile emits two infrared signals which are received by two separate sensors on the launcher site. A missile guidance unit electronically coupled to the site and the launcher calculates missile position information and sends frequency modulated steering corrective signals to the missile through a wire link. The missile electronics unit receives the pitch and yaw correction signals and combines them with roll and yaw error signals from gyros within the missile to generate commands for positioning the missile control surfaces which, in turn, control the direction of the missile. The guidance process above repeats itself until the missile engages with the target.

The prior TOW missile electronics unit utilized hardware components to accomplish discrimination of frequency modulated pitch and yaw steering correction signals from the guidance unit, noise filtering of discriminated correction signals, system loop filter stability compensation, gyro loop compensation and self-balance loop stability. These hardware components added weight, size, and cost to the missile.

SUMMARY OF THE INVENTION

In accordance with the teachings of the present invention, an apparatus for controlling an airborne vehicle, such as a missile, is provided. The apparatus includes a guidance unit, remotely located from the airborne vehicle, which generates frequency modulated steering and control signals. A signal conditioning circuit, within the vehicle, conditions the steering and control signals. An attitude position sensing circuit, within the vehicle, senses and generates attitude position information. A programmable microcontroller, within the vehicle, receives the steering and control signals from the signal conditioning circuit and vehicle attitude position information from the attitude position sensing circuit, and generates flight commands for generating flight commands for controlling the flight of the vehicle.

BRIEF DESCRIPTION OF THE DRAWINGS

Other objects and advantages of the invention will become apparent upon reading the following detailed description and upon reference to the drawings, in which.

DETAILED DESCRIPTION OF THE PREFERRED EMBODIMENT

Figure 1:
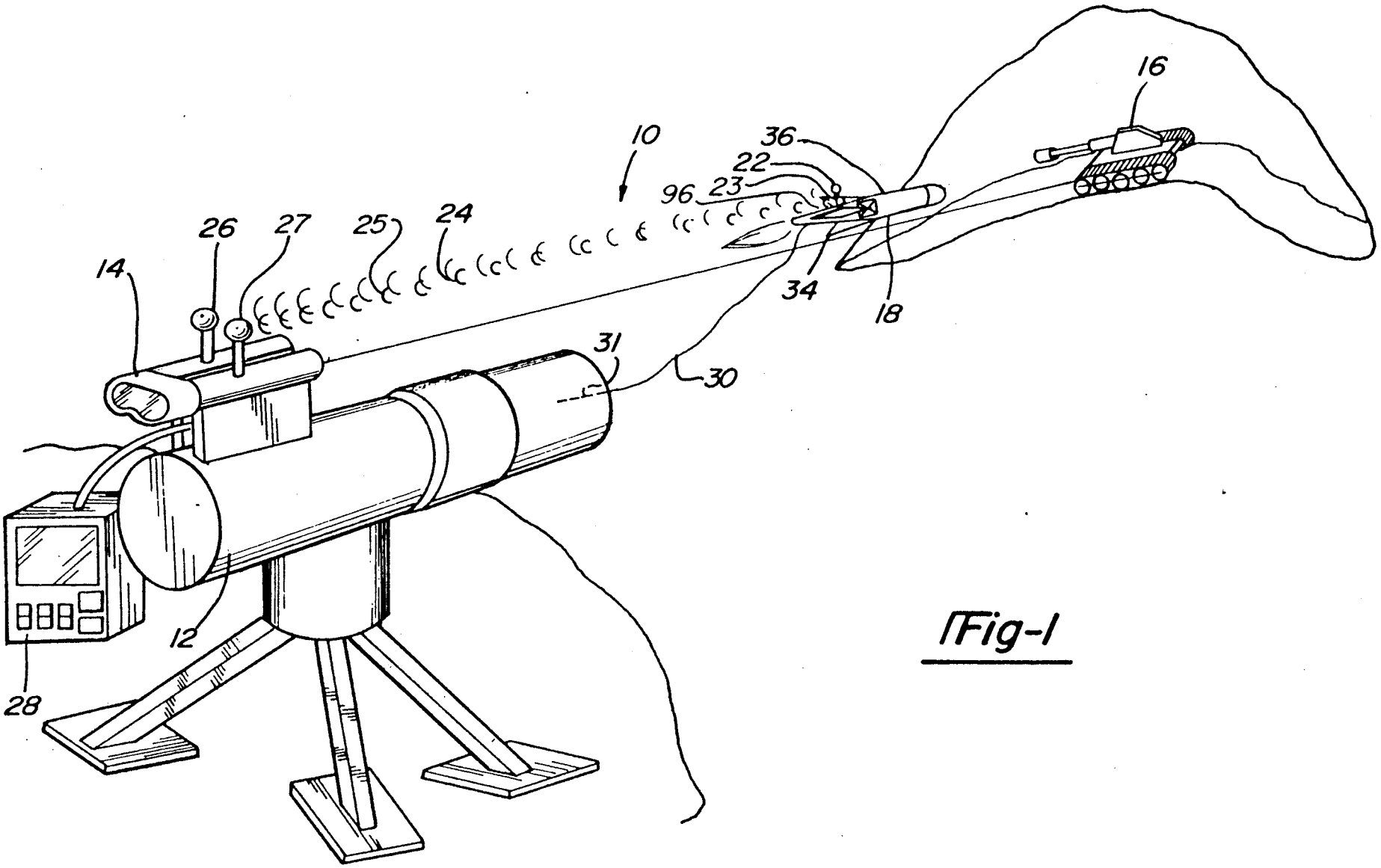
FIG. 1 is a perspective view showing the basic components of the TOW missile system.

The basic operation of the TOW weapon system 10 is illustrated in FIG. 1. The launcher 12 is aligned with the target 16 using optical site 14. The site 14 has a day setting and a night setting. With site 14 maintained on the target 16, the firing mechanism is engaged thereby launching the missile 18. During its flight, the missile 18 sends back two modulated infrared signals 24 and 25 having different frequencies from infrared beacons 22 and 23 which are received by two separate infrared sensors 26 and 27 on the launcher site 14. Infrared beacon 22 emits signal 24, which is suitable for daytime and clear weather conditions. Infrared beacon 23 is suitable for night and cloudy, hazy or smoky conditions. Together, beacons 22 and 23 ensure that the missile guidance unit 28 receives a constant stream of information from the missile 18. The missile guidance unit 28 calculates missile position information from the modulated infrared beam 24 or 25 and generates corrective steering signals to put the missile 18 back on a path to the target 16.

An additional feature of the missile 18 is the shutter 96 on the beacon 23. The missile guidance unit 28 generates control signals for opening and closing the shutter 96, which are transmitted over the wires 30 to the missile 18. The opening and closing of the shutter 96 differentiates the beacon 23 from other emitting or "hot" sources along the missile's path.

The corrective steering signals sent from the missile guidance unit 28 are transmitted over the two wires 30 to an electronics unit 36 at the rear of the missile 18. The missile electronics unit 36 couples internally generated attitude position information from its gyros with the corrective steering signals from the guidance unit 28 and generates command signals for actuating the missile flight control surfaces 34.

The steering signals generated by the guidance unit 28 contain pitch and yaw information. Pitch angles are generally measured relative to a horizontal axis through the missile 18 and yaw angles are measured relative to a vertical axis through the missile 18. The control surfaces 34 increase and decrease the pitch and yaw angles in cyclic fashion. The time spent increasing pitch and yaw angles relative to the time spent decreasing pitch and yaw angles determines whether the missile goes up or down, turns left or right.

The guidance unit 28 generates a continuously variable amplitude carrier (CVAC) signal for the pitch and yaw control surfaces 34, which determines the time spent increasing pitch and yaw angles relative to the time spent decreasing pitch and yaw angles. The CVAC signal is a sinewave in which the positive amplitude portion represents an increase in the angle of the control surfaces 34, and the negative portion represents a decrease in the angle of the control surfaces. Moving the sinewave axis up or down determines the ratio of time spent increasing control surface angles to decreasing control surface angles. The point on the sinewave through which the axis cuts is the "zero-crossing" point. The pitch and yaw CVAC signals are frequency modulated by the guidance unit 28 and discriminated (reconstructed) by the electronics unit 36.

Figure 2:
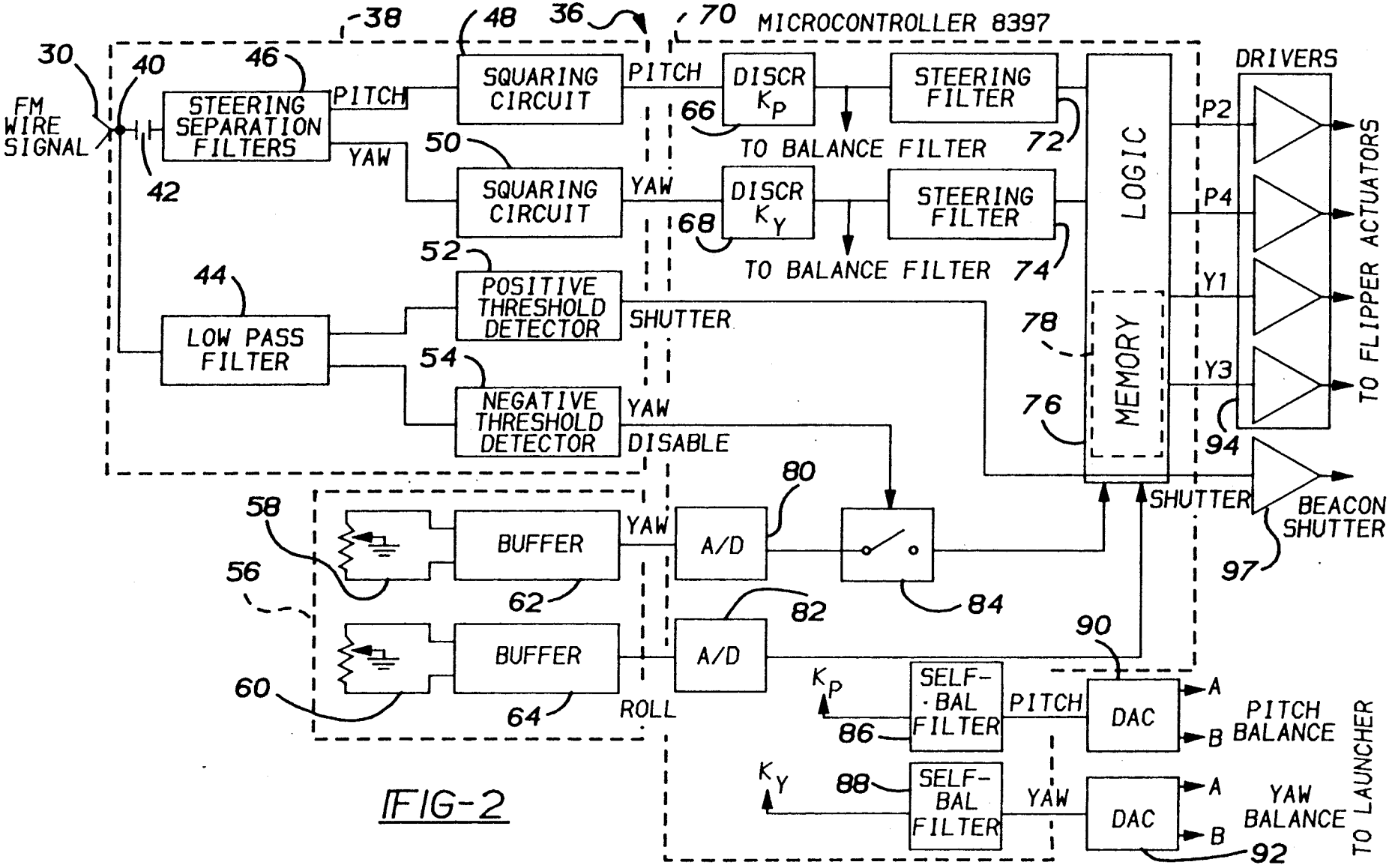
FIG. 2 is a block diagram of the missile electronics unit, including the microcontroller.

In FIG. 2 a block diagram of the electronics unit 36 is shown. On the lower left side of the diagram is the attitude position sensing circuit 56. Within the missile 18, the yaw gyro 58 and a roll gyro 60 generate attitude position information to be used by the microcontroller 70. The signals from the gyros are smoothed and amplified by the buffer circuits 62 and 64.

Frequency modulated signals from the guidance unit 28 enter the electronics unit 36 on the left side of the diagram at the input 40 of conditioning circuit 38. The primary purpose of the conditioning circuit 38 is to divide the transmitted signal into four different intelligence signals. Higher frequency pitch and yaw steering signals are separated from lower frequency control signals by capacitor 42 and low pass filter 44. Steering signals are separated into frequency modulated pitch and yaw signals by the steering separation filter 46. The pitch and yaw steering signals are then amplitude limited by the pitch squaring circuit 48 and the yaw squaring circuit 50, respectively. After passing through the low pass filter 44, the control signals are separated into a shutter open or close signal, for opening or closing the shutter 96 of beacon 23, and a yaw disable signal. The latter is sent by the guidance unit 28 to disconnect yaw gyro position information from the microcontroller 70 as soon as the missile 18 has stabilized after launch, the yaw gyro position information being no longer required to steer the missile 18. Positive threshold detector circuit 52 is used to sense a shutter open or close signal and negative threshold voltage detector circuit 54 is used to detect a yaw disable signal.

The microcontroller 70 operates in two stages, before (pre-fire) and after (fire) first motion of the missile 18. During an approximate 1.5 second period (pre-fire) after the firing mechanism is triggered, but prior to first motion, the missile 18 goes through a self-balancing routine. During this time, the pitch and yaw steering filters 72 and 74 are decoupled from the discriminators 66 and 68. Pitch and yaw self-balance filters 86 and 88 are coupled to the discriminators 66 and 68 by a software coupling means which is controlled by a wire 31 between the missile 18 and the launcher 12, the wire 31 being part of a circuit that is grounded at the launcher 12 before launch. The self-balance filters 86 and 88 are much like the steering filters 72 and 74 except the self-balance filters 86 and 88 are optimized for precise calibration of the launcher oscillators to the missile oscillator.

The launcher timing sequence causes the guidance unit 28 to transmit an unmodulated, constant frequency signal through the wires 30 and into the missile electronics unit 36. Since the signal is unmodulated, the output of the pitch and yaw discriminators 66 and 68 are converted to digital code representing constant voltages, ideally zero volts. The self-balance filters 86 and 88 filter the digital code using bilinear transform techniques, and then send the filtered codes on to the digital-to-analog converters 90 and 92 where they are converted back into analog voltages and sent to a voltage comparison circuit within the guidance unit 28. This feedback process repeats itself until the voltage received by the guidance unit 28 corresponds to the voltage transmitted.

After first motion and throughout flight, frequency modulated pitch and yaw signals from the guidance unit 28 are discriminated by discriminators 66 and 68. In more detail, during flight, the discriminators 66 and 68 reconstruct the CVAC signal from the steering signals generated by the guidance unit 28. Specifically, the guidance unit 28 frequency modulates the CVAC signal and the missile discriminators 66 and 68 demodulate the steering signals back into the CVAC signal. It is the microcontroller software that actually performs the demodulation process. The software program calculates the precise period of the carrier frequency and converts each period to a specific digital number. Each number represents a specific point on the CVAC sinusoidal function. The output signal of the discriminators 66 and 68 is a sinusoidal function of frequency, the positive amplitude side of the discriminated pitch signal representing a higher frequency or pitch angle increase signal and the negative amplitude side representing a lower frequency or pitch angle decrease signal. The operation of the yaw discriminator 68 is similar. Unlike the prior electronics unit, the present invention uses microcontroller software for the discriminators 66 and 68. The microcontroller uses a crystal oscillator thereby virtually eliminating missile drift error due to reference frequency shift during flight.

The digitally discriminated pitch and yaw signals are smoothed by the pitch and yaw steering filters 72 and 74. These filters use software employing bilinear transform techniques to filter the noise caused by discrimination digitizing of these signals. The pitch steering filter 72 and the yaw steering filter 74 complete the reconstruction of the CVAC signal in digital form.

The yaw and roll error signals from the attitude position sensing circuit 56 enter the microcontroller 70 and are converted to digital signals by analog-to-digital converters 80 and 82. Unlike the prior electronics unit, the present invention uses microcontroller software rather than "selected" hardware components to calibrate the yaw/roll error signals. The digital roll signal enters the logic unit 76 for processing by the software. As mentioned previously, the yaw error signal is normally inhibited during flight by the yaw decoupler 84 since yaw error signals from the yaw gyro 58 are only needed during early launch when the flight of the missile is most unstable. Shortly after launch, the missile guidance unit 28 sends a yaw disable signal, having a direct voltage level, into the microcontroller 70 where it sets a yaw disable flag.

After the yaw disable voltage level is set, the guidance unit 28 sends a shutter open or close signal, having a direct voltage level, which enters the microcontroller 70 and is processed by the logic unit 76. The software determines whether or not the shutter 96 of the infrared beacon 23 is open or closed. It also generates a pulse used by the driver 97 to open or close the shutter 96.

The microcontroller 70 uses software to generate the missile control actuator commands used by the drivers 94 to position the control surfaces 34. The advantages of this approach are that it results in a significant reduction in size and cost. There is no need to "select" hardware components to achieve the required system accuracy because the software contains built-in self-calibration routines. The microcontroller 70 executes several software routines in response to transitory signals called interrupts. The software is stored in the memory 78 and is advantageously capable of being changed independently of the launcher 12.

Figure 3:
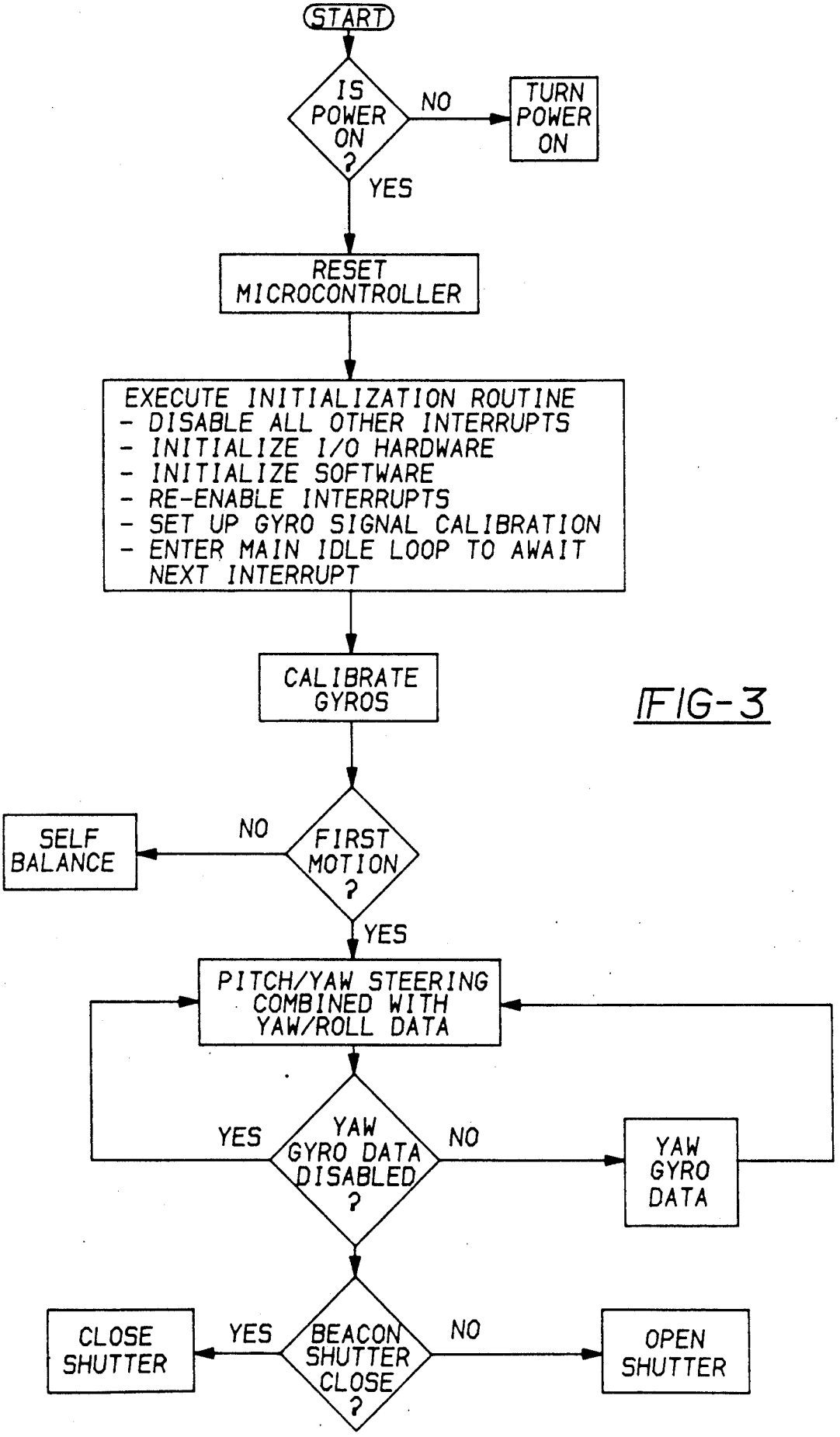
FIG. 3 is a flowchart of the basic functions of the microcontroller.

The method for controlling the missile 18 is illustrated by the software flow diagram in FIG. 3. The first step is to execute the initialization routine. The initialization routine is executed by the software when the microcontroller 70 receives a reset interrupt. The reset interrupt is generated by applying power to the missile 18. The initialization routine disables all other interrupts, initializes input and output hardware, and initializes software. After these jobs are complete, the initialization routine re-enables all interrupts, calibrates the outputs from the gyros, and enters a main idle loop to await the next interrupt.

The second step is balancing or calibrating the modulation frequencies of the launcher 12 to that of the missile 18. The high-speed input data available interrupt (HSI-D-A) routine is used in the balance process when the microcontroller receives HSI-D-A interrupts. The HSI-D-A interrupts are generated from an unmodulated (no CVAC signal present) constant frequency pitch and yaw calibration signal sent from the guidance unit 28 to the missile 18 prior to first motion of the missile 18. The calibration signal passes through the squaring circuits 48 and 50. The HSI-D-A interrupt is keyed by periodic zero-crossing transitions of the calibration signal. It is the time segment between each interrupt that determines the digital output value of the discriminators 66 and 68. When the discriminated output values from the pitch and yaw balance filters 86 and 88 equal zero, the guidance unit 28 is calibrated to the missile electronics unit 36.

The third step is to detect first motion of the missile 18. Motion of the missile 18 is determined when wire 31 between the missile 18 and the launcher 12 breaks, thereby breaking a ground connection to an input port of the microcontroller 70. The breaking of the wire is sensed by the microcontroller 70 as an external interrupt. An external interrupt invokes the external interrupt service routine, which sets a flag to indicate that first motion has occurred. After first motion, the pitch and yaw balance filters 86 and 88 are decoupled from the discriminators 66 and 68 and the pitch and yaw steering filters 72 and 74 are coupled to the discriminators 66 and 68.

The fourth step is to receive steering signals from the guidance unit 28. Receipt of steering signals generates HSI-D-A interrupts within microcontroller 70. The HSI-D-A routine determines whether the interrupt was generated by a pitch or a yaw signal transition. Subsequent to first motion, the routine performs pitch or yaw steering command discriminator processing. It filters the pitch or yaw steering signals using bilinear transform techniques as they pass through the pitch and yaw steering filters 72 and 74 and then stores them in memory 78 to await further processing.

The fifth step is to receive roll and yaw error signals from the attitude position sensing circuit 56. Receipt of roll and yaw error signals generates an analog-to-digital conversion complete interrupt (AD-CONVR). Prior to launch, the gyro outputs are calibrated by the software. In flight, the AD-CONVR routine filters the appropriate gyro data using bilinear transform techniques and scales the result for use in generating control actuator commands. The gyro data is stored in memory 78 to await further processing. The yaw gyro data is discarded if the yaw disable flag has been set.

The sixth step is to combine the pitch and yaw steering signals with the roll and yaw error signals and generate control actuator commands. The HSI-D-A routine executes a function for generating the commands. Provision is also made within the HSI-D-A routine for the additional steps of receiving a shutter control signal from the guidance unit 28, determining the status of the shutter 96, and generating a pulse for opening or closing the shutter 96.

Although the invention has been described with particular reference to certain preferred embodiments thereof, variations and modifications can be effected within the spirit and scope of the following claims. For example, while the microcontroller 70 of the preferred embodiment is commercially available from Intel Corporation as model number 8397, other suitable programmable machines can be employed.

What is claimed is:

1. An apparatus for controlling an airborne vehicle, said apparatus comprising:

(a) guidance means, remotely located from said airborne vehicle, for generating frequency modulated steering and control signals;

(b) signal conditioning means, within the airborne vehicle, for conditioning the steering and control signals from said guidance means;

(c) position sensing means, within the airborne vehicle, for sensing and generating vehicle position information; and (d) a programmable microcontroller, within the airborne vehicle, for receiving the steering and control signals from said signal conditioning means and vehicle position information from said position sensing means, and for generating flight commands for controlling the flight of the vehicle, the microcontroller further including means for providing discrimination and filtering for demodulating the frequency modulated steering and control signals.

2. The apparatus of claim 1 wherein said microcontroller comprises:

(a) pitch discriminator means for generating an output distinguishing between pitch angle increase and pitch angle decrease information in the steering signals;

(b) yaw discriminator means for generating an output distinguishing between yaw angle increase and yaw angle decrease information in the steering signals; said output signals from the pitch and yaw discriminator means being digitally coded periodic functions of frequency;

(c) pitch steering filter means, coupled to said pitch discriminator means, for filtering the digital noise out of said digital code, and for optimizing pitch guidance loop stability;

(d) yaw steering filter means, coupled to said yaw discriminator means, for filtering the digital noise out of said digital code, and for optimizing yaw guidance loop stability; and (e) a logic unit, coupled to the pitch and yaw filter means, for generating flight commands for positioning the pitch and yaw flight control surfaces on the vehicle.

3. The apparatus of claim 2 wherein the microcontroller further comprises:

means for additionally coupling the digital outputs of the pitch and yaw steering filter means to said guidance means.

4. The apparatus of claim 3 wherein said coupling means includes:

an electrical connection between the pitch and yaw steering filter means and the guidance means, said connection being broken by first motion of the airborne vehicle.

5. The apparatus of claim 4 wherein said microcontroller further comprises:

(a) a yaw analog-to-digital converter coupled to said logic unit for converting a yaw error signal in the vehicle position information to a digital code;

(b) a roll analog-to-digital converter, coupled to said microprocessor for converting a roll error signal in the vehicle position information to a digital code; and (c) means for decoupling the yaw analog-to-digital converter from the logic unit upon receipt by said decoupling means of a yaw disable signal from said guidance means.

6. The apparatus of claim 5 wherein said microcontroller further comprises:

(a) yaw self- balance filter means, coupled to the yaw discriminator means prior to first motion of the vehicle, for filtering the digital noise out of said digital code, and for optimizing yaw guidance loop stability; and (b) pitch self-balance filter means, coupled to the pitch discriminator means prior to first motion of the vehicle, for filtering the digital noise out of said digital code, and for optimizing pitch guidance loop stability.

7. The apparatus of claim 6 wherein said logic unit includes:

(a) means for sensing the status of an infrared beacon shutter, said status being open or closed; and (b) means for generating a pulse for opening or closing said shutter upon receipt by said generating means of a shutter-control signal from said guidance means.

8. The apparatus of claim 7, wherein said position sensing means comprises:

(a) a yaw gyro, within the airborne vehicle, said yaw gyro generating the yaw error signal;

(b) a roll gyro, within the airborne vehicle said roll gyro generating the roll error signal;

(c) a yaw buffer circuit means for smoothing and amplifying the yaw error signal; and (d) a roll buffer circuit means for smoothing and amplifying the roll error signal.

9. The apparatus of claim 7, wherein the signal conditioning means comprises:

(a) steering and control signal input means for receiving steering and control signals from the guidance unit, said steering signals being pitch and yaw steering signals and said control signals being said yaw disable and shutter control signals;

(b) capacitive means coupled to said steering and control signal input means, for passing and separating steering signals from control signals;

(c) steering separation filter means, coupled to the capacitive means, for separating pitch and yaw steering signals, said pitch steering signals being pitch angle increase and pitch angle decrease signals, and said yaw steering signals being yaw angle increase and yaw angle decrease signals;

(d) pitch squaring circuit means coupled to said steering separation filter means, for limiting both the positive and negative peaks of the pitch steering signal to a predetermined level;

(e) yaw squaring circuit means, coupled to said steering separation filter means, for limiting both the positive and negative peaks of the yaw steering signal to a predetermined level;

(f) low pass filter means, coupled to said steering and control signal input means for passing control signals;

(g) positive threshold voltage detector means coupled to said low pass filter means for sensing said shutter control signal, and for passing said shutter control signal to said logic unit; and (h) negative threshold voltage detector means coupled to said low pass filter means for sensing a yaw disable signal, and for passing said yaw disable signal to said means for decoupling the yaw analog-to-digital converter from the logic unit.

10. The apparatus of claim 7 wherein said guidance means includes a pitch and yaw calibration means for generating an unmodulated, constant frequency signal before first motion of the airborne vehicle, said constant frequency signal being received by the steering and control signal input means, the pitch and yaw calibration means further including:

(a) pitch and yaw analog-to-digital converters for converting the output of the pitch and yaw balance filter means to analog signals; and (b) signal comparison means for comparing said pitch and yaw analog signals to the constant frequency signal.

11. The apparatus of claim 7 wherein the steering and control input means is coupled to the output of the guidance means by two wires.

12. The apparatus of claim 7 wherein said airborne vehicle is a missile.

13. A programmable microcontroller circuit for controlling a missile comprising:

(a) pitch discriminator means for generating a digital output distinguishing between pitch angle increase and pitch angle decrease information in a frequency modulated pitch steering signal having information therein relating to the desired pitch of the missile;

(b) yaw discriminator means for generating a digital output distinguishing between yaw angle increase and yaw angle decrease information in a frequency modulated yaw steering signal having information therein relating to the desired yaw of the missile, said output signals from the pitch and yaw discriminator means being a digital sinusoidal function;

(c) pitch steering filter means coupled to the pitch signal discriminator means for filtering the digital noise out of said digital code, and optimizing pitch guidance loop stability;

(d) yaw steering filter means, coupled to the yaw steering discriminator means for filtering the digital noise out of said digital code, and optimizing yaw guidance loop stability;

(e) a logic unit, coupled to the pitch and yaw filter means, for generating flight commands for positioning the missile pitch and yaw flight control surfaces; and (f) means for additionally coupling the outputs of the pitch and yaw steering filter means to said guidance means, said coupling means including an electrical connection between the pitch and yaw steering filter means and the guidance means, said connection being broken by first motion of the missile.

14. The microcontroller of claim 13 further comprising:

(a) a yaw analog-to-digital converter coupled to said logic unit for converting a yaw error signal, having information therein relating to the position of the missile, to a digital code;

(b) a roll analog-to-digital converter coupled to said microprocessor for converting a roll error signal, having information therein relating to the position of the missile, to a digital code; and (c) means for decoupling the yaw analog-to-digital converter from the logic unit upon receipt by said decoupling means of a yaw disable signal.

15. The microcontroller of claim 14 further comprising:

(a) a yaw self-balance filter means, coupled to the yaw discriminator means prior to first motion of the missile for filtering the digital noise out of said digital code, and optimizing yaw loop stability for pre-fire system calibration; and (b) a pitch self-balance filter means coupled to the pitch discriminator means prior to first motion of the vehicle for filtering the digital noise out of said digital code, and optimizing pitch loop stability for pre-fire system calibration.

16. The microcontroller of claim 13 wherein said logic unit includes:

(a) means for sensing the status of an infrared beacon shutter, said status being open or closed; and (b) means for generating a pulse for opening or closing said shutter upon receipt by, said generating means of a shutter control signal from said aid guidance means.

* * * * *